US006997647B2

(12) United States Patent
Bennett, Jr. et al.

(10) Patent No.: US 6,997,647 B2
(45) Date of Patent: Feb. 14, 2006

(54) ACTIVE HOLD DOWN SYSTEM FOR JACK-UP DRILLING UNIT

(76) Inventors: William T. Bennett, Jr., 301 Avenue E, Metairie, LA (US) 70005; Eugene E. Begnaud, 27 Park Timbers Dr., New Orleans, LA (US) 70131

( * ) Notice: Subject to any disclaimer, the term of this patent is extended or adjusted under 35 U.S.C. 154(b) by 96 days.

(21) Appl. No.: 10/611,010

(22) Filed: Jul. 1, 2003

(65) Prior Publication Data

US 2004/0067110 A1 Apr. 8, 2004

Related U.S. Application Data

(60) Provisional application No. 60/393,350, filed on Jul. 1, 2002, provisional application No. 60/393,245, filed on Jul. 2, 2002.

(51) Int. Cl.
*E02B 17/00* (2006.01)
*B63B 35/44* (2006.01)

(52) U.S. Cl. ..... 405/201

(58) Field of Classification Search ..... 405/201, 405/195.1, 202

See application file for complete search history.

(56) References Cited

U.S. PATENT DOCUMENTS

| | | | | |
|---|---|---|---|---|
| 3,477,235 | A * | 11/1969 | Hester, Jr. et al. | 405/201 |
| 4,823,870 | A * | 4/1989 | Sorokan | 405/201 |
| 5,052,860 | A * | 10/1991 | Ingle | 405/201 |
| 5,407,302 | A * | 4/1995 | Springett et al. | 405/196 |
| 6,171,027 | B1 * | 1/2001 | Blankestijin | 405/201 |
| 6,491,477 | B1 * | 12/2002 | Bennett et al. | 405/201 |
| 6,729,804 | B1 * | 5/2004 | Roodenburg et al. | 405/201 |

* cited by examiner

*Primary Examiner*—Frederick L. Lagman
(74) *Attorney, Agent, or Firm*—Keaty Professional Law Corporation

(57) ABSTRACT

A cantilever beam of a jack-up unit is provided with constant force restraining members mounted on a deck of a jack-up unit forward from conventional hold-down cantilever beam clamp. A modified cantilever beam end plate engages a first end of constant force restraining member, which may be a hydraulic cylinder, with the second end of the hydraulic cylinder secured to movable padeye, which is releasably secured to the deck of the jack-up unit. If desired a fixed foundation may be secured to the deck to reinforce the area of attachment of a padeye to the deck. To allow extension of the cantilever beam even farther to a drill well, an extension member may be attached to the end plate between a free end of the end plate and the hydraulic cylinders.

20 Claims, 8 Drawing Sheets

ACTIVE HOLD DOWN SYSTEM FOR JACK-UP DRILLING UNIT

CROSS-REFERENCE TO RELATED APPLICATIONS

This non-provisional application claims the benefit of 60/393,245 filed Jul. 2, 2002 and is based on and claims the benefit of our provisional application Ser. No. 60/393,350 filed on Jul. 1, 2002, entitled "Active Hold Down System for Jack-up Drilling Unit," the full disclosure of which is incorporated by reference herein.

BACKGROUND OF THE INVENTION

The present invention relates to an oil and gas industry, and, more particularly to a drilling jack-up platform that can be used to develop wells in an offshore location. Even more particularly, the invention relates to a hold down system that can be used for restraining the ends of cantilevers and cantilever extensions of jack-up units.

Jack-ups, which were designed and built more than thirty years ago and even more recently, were initially designed for drilling through a slot at the stem of the unit and were not capable of working over a platform.

By the late 1970's new designs were introduced for work-over operations. These jack-ups had cantilever beams that could skid aft over the stem. The drill floor was allowed to skid port/starboard. The well drilling pattern typically covered a well center location of 40 feet aft of stern and 12 feet port-starboard of the longitudinal centerline. As the well location moved farther aft and more to port or starboard, the allowable load due to hook, rotary, setback, and later, conductor tension was significantly reduced. This limiting allowable load was reduced further as drilling equipment was upgraded adding weight.

Now, with the importance of shallow water deep reservoirs, the demand for upgrading these jack-up units for both extended reach and higher loads at the extended reach is very high. The areas, which are usually affected by the required upgrade modification, are cantilever strength due to increased bending moment and shear, hull transom and stern support reinforcement, and most importantly the hold-down clamp increase in capacity.

The hold-down clamp is a close tolerance high load structure, which keeps the forward end of the cantilever from rotating up when the cantilever is skidded aft. Often, the hold down clamp is located in the SCR room. If the hold-down clamp capacity is increased expensive modifications become necessary. Additionally, when the hold-down clamp is modified by lengthening the clamp in the aft direction, the distance between the clamp and the stern reaction is reduced, which causes higher reaction values. If the hold-down clamp is lengthened in the forward direction, the aft skidding extent is reduced. Consequently, the hold-down clamp is usually not upgraded and load chart valves are often compromised.

The present invention solves the problem of a clamp hold down by utilizing an active hold-down system.

SUMMARY OF THE INVENTION

It is, therefore, an object of the present invention to provide a hold-down system for a cantilever of a jack-up unit.

It is another object of the present invention to provide an active hold-down system for a cantilever that applies a constant force to the forward end of the cantilever.

It is a further object of the present invention to provide an active hold-down system that can be used for restraining an existing cantilever or a new extension portion when the cantilever is extended aft.

These and other objects of the present invention are achieved through a provision of an active hold-down system that exerts a constant restraining force on a cantilever of a jack-up unit, particularly on a free forward end of the cantilever. The system utilizes a plurality of hydraulic cylinders that are attached to the cantilever through a modified end plate. The second end of the restraining cylinders is secured to the deck of the jack-up unit forward of a conventional hold-down clamp. The restraining force provided by the hydraulic cylinders has a vertical component, with the cylinders extending at an angle to a horizontal extension of the cantilever beam.

A plurality of movable padeyes secures the hold-down members to the deck. Depending on the expected maximum load, the padeyes may be secured directly to a deck, with a reinforcing insert plate mounted below the deck in the area of the padeye attachment, or to a fixed foundation welded to the deck.

An optional extension member may be mounted forward of the end plate for allow even more extension of the restraining members towards the forward end of the cantilever.

BRIEF DESCRIPTION OF THE DRAWINGS

Reference will now be made to the drawings, wherein like parts are designated in like numerals, and wherein.

DETAIL DESCRIPTION OF THE PREFERRED EMBODIMENT

Figure 1:
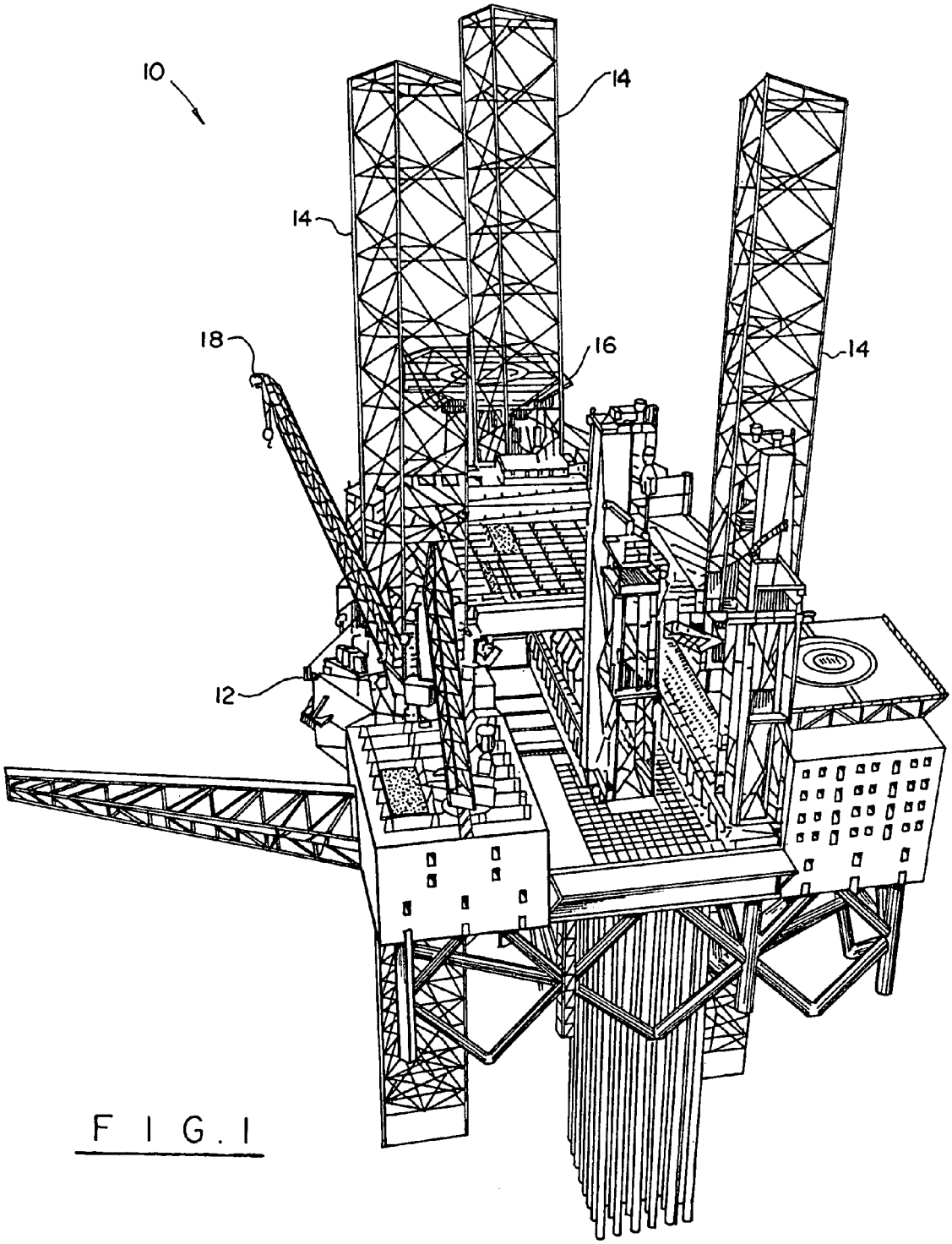
FIG. 1 is a perspective view of a cantilever jack-up unit deployed at a drilling site with a cantilever assembly extending over a fixed platform.
Figure 2:
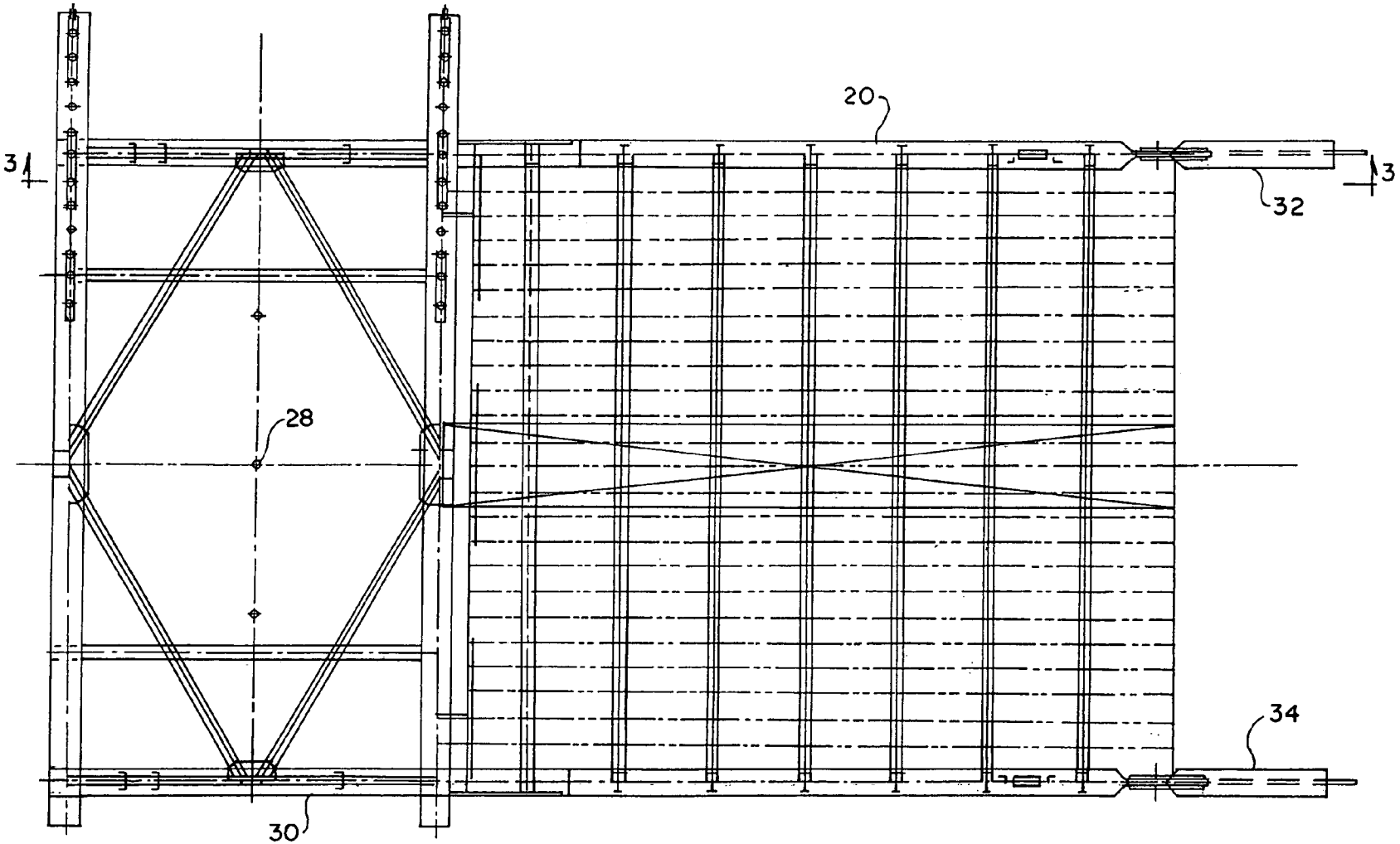
FIG. 2 is a plan view of a pipe rack deck showing a pair of active hold-down members secured to an optional portable extension.
Figure 3:
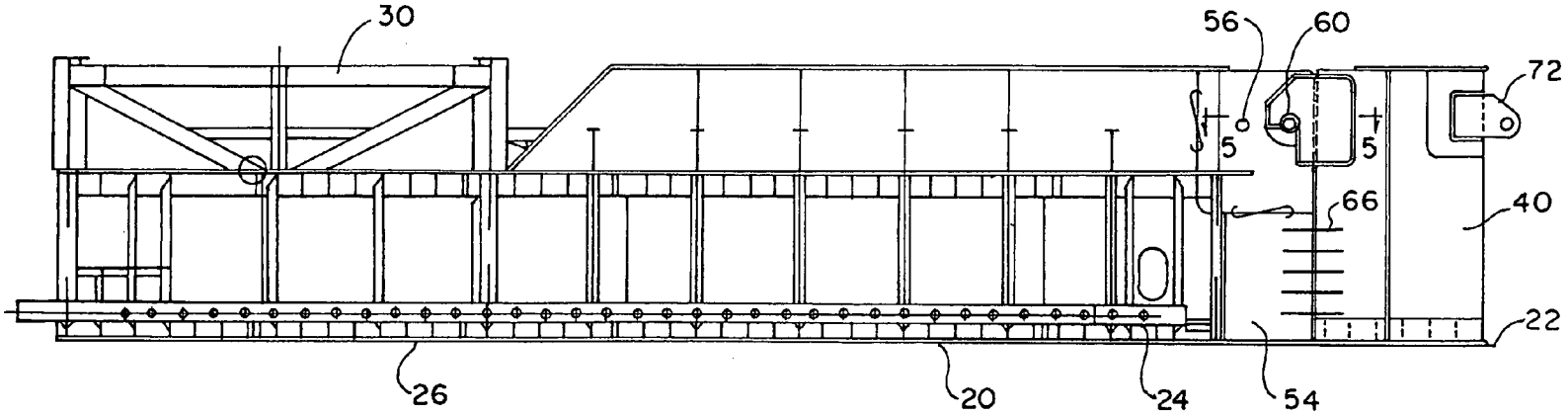
FIG. 3 is a port side view facing outboard and showing attachment of the optional cantilever beam extension taken along lines 3—3 in FIG. 2.

Turning now to the drawings in more detail, numeral 10 designates a self-elevating platform or a jack-up unit with a cantilever extension. The unit 10 typically comprises an elevated hull 12 supported and movable in relation to a plurality of supporting legs 14 that support the hull 12 at roughly the geometric corners of the hull.

Conventionally, the unit 10 is floated to the deployment site with legs fully extended above the hull. Once the platform 10 reaches the site of the expected operations, the legs are lowered, embedded in the ocean floor, and the hull 12 is raised to the operational draft by a system of elevating jacks.

The platform 10 is designed to support drilling equipment, storage of operational consumables and accommodate living quarters of the crew. These facilities are positioned on different decks of the hull 12 to fully maximize the valuable space afforded by the offshore structure. Tubulars are conventionally stored in the open areas of the decks and cantilevers.

The unit 10 can also be provided with a heliport 16 and a number of cranes 18 for lifting of the loads on the platform 10. One or more cantilever assemblies 20 are secured to the hull 12. The cantilever assemblies move in relation to the hull 12, extending and retracting in relation to the hull. The cantilever assemblies can be designed to house some of the drilling equipment that is integral to the drilling process, mud processing equipment, shale shakers, and solids control of the mud system. Diesel driven cementing equipment can be provided in the cantilever assemblies to control the wells in case of an emergency. The hydraulic control for the blowout preventor can be located in the cantilever assemblies, as well.

Conventionally, the cantilever assemblies are tied down to the elevating hull, such as the hull 12, by a structure from below the cantilever beam. The present invention provides a novel restraining system for the cantilever beams. According to the present invention, an active hold-down system is employed to apply a constant force to the forward end of the cantilever beam. Hydraulic cylinders are used as the hold-down members. The main deck and under deck reinforcement for the restraint system is positioned forward of the existing hold-down clamp. If the well pattern is extended aft, the active hold-down system of the present invention can apply load to either the existing cantilever or to an optional extension member secured to the cantilever beam.

As can be better seen in the drawings, the cantilever beam assembly 20 extends from a main deck 22 of the platform 10. The cantilever assembly 20 has a proximate end 24 and a distant end 26. The distant end 26 extends over a center of a well 28 supporting the drilling assembly superstructure 30.

The main deck tie-down structure for the hold-down system of the present invention is positioned at multiple pre-determined locations both port and starboard to allow the hold-down system to apply loads to the cantilever beam consistent with the area of the well center. This system can work with wells having their centerlines located at a range of distances aft of transom. A pair of constant force hydraulic cylinders, or hold-down members 32 and 34 are each secured to the upper area of the cantilever beam 20 and to movable hold-down padeyes 36, 38. The padeyes 36, 38 are restrained by securing them to the main deck 22. The constant force cylinders 32, 34 apply a force that has a vertical component, which improves the load capacity of the system.

Figure 5:
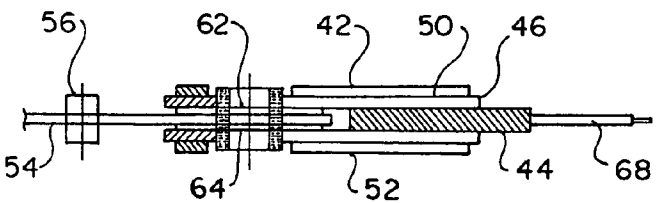
FIG. 5 is a detail cross sectional view of a connection assembly for the cantilever beam extension taken along lines 5—5 in FIG. 3.
Figure 4:
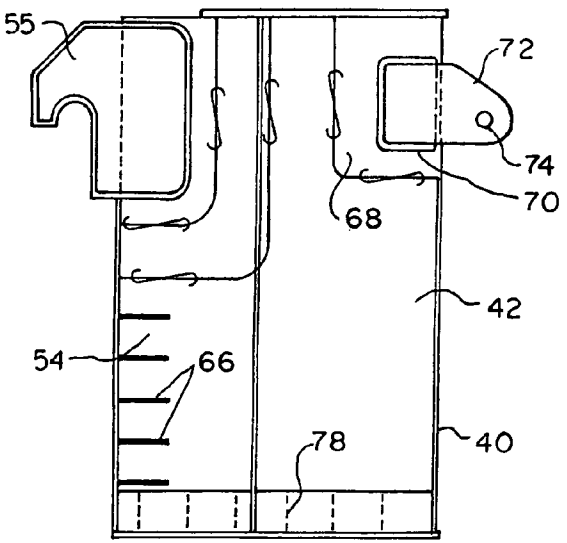
FIG. 4 is a detail view of the optional cantilever beam extension.
Figure 18:
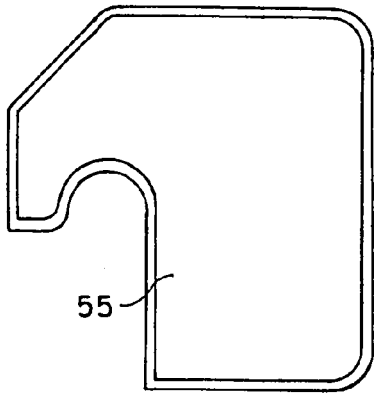
FIG. 18 is a detail view of an extension clevis for securing the optional cantilever beam extension.

An optional cantilever beam extension assembly 40 is secured at each side of the proximate end 24 of the beams. The cantilever beam extension assembly 40 comprises a connection assembly shown in more detail in FIG. 5. The connection assembly 42 comprises a central plate 44 "sandwiched" between a pair of reinforcement plates 46, 48. A pair of outer cheek plates 50, 52 are secured to the outside of the reinforcement plates 46, 48. A modified cantilever beam end plate 54 carries a fixed securing pin 56. An extension clevis 55 (shown in more detail in FIG. 18) engages a clevis securing pin 60, which is affixed to the plate 54 a distance from the securing pin 56.

The clevis-securing pin 60 engages the end plate 54 at a location between the pin 56 and the central plate 44. A pair of reinforcement plates 62, 64 pass through the pin 60. A plurality of horizontal ties 66 span between the plate 44 and the end plate 54. Extending on the opposite side of the main plate 44 is a second connecting plate 68, which is provided with a cutout 70 for securing a bracket 72 therein.

The bracket 72 is provided with an opening 74. A first securing rod 76 of hold-down member 80 is secured through the opening 74 to the extension assembly 40. The extension assembly 40 is detachably attached to the main deck 22 by bolts 78 or similar attachment means. The extension assembly 40 can be easily re-positioned or entirely removed if not needed.

Figure 6:
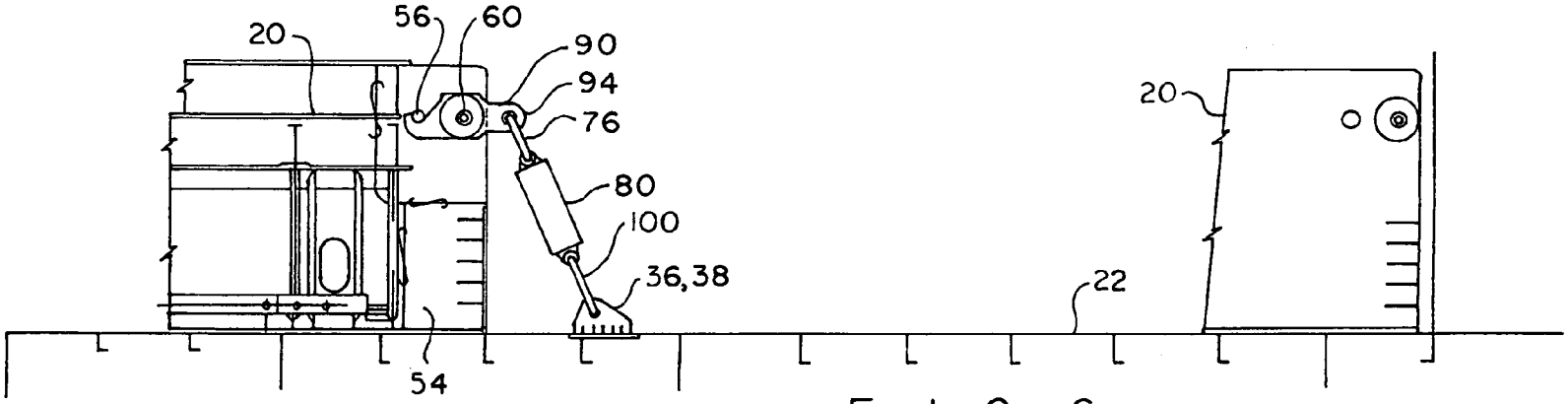
FIG. 6 is a detail view showing the active hold-down member secured to a fully extended cantilever beam without using the cantilever beam extension suitable for extreme well centers aft of transom and also showing a first embodiment of a means for securing the hold-down member to the main deck.
Figure 7:
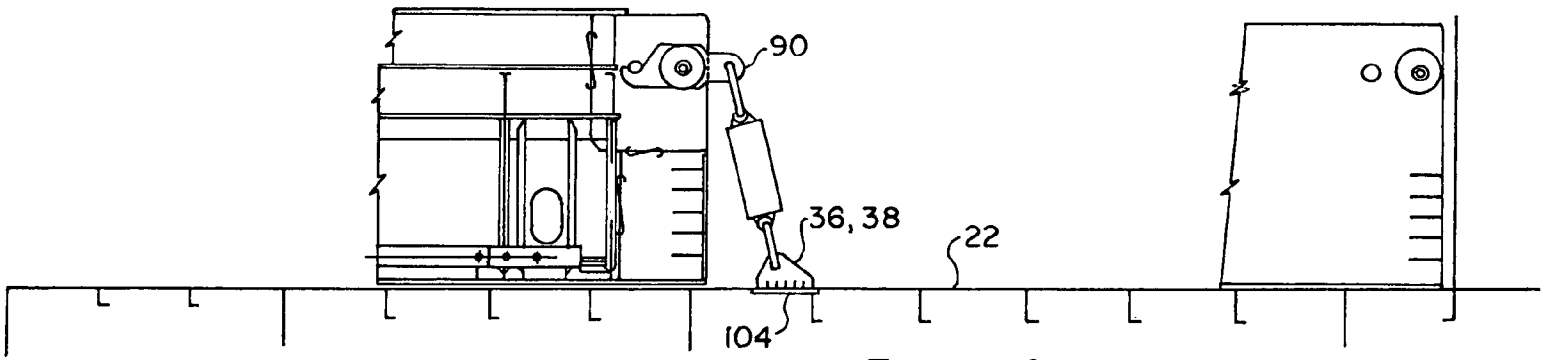
FIG. 7 is a view similar to the view of FIG. 6 showing the active hold-down member secured to a cantilever beam not fully extended suitable for well centers at less extreme positions aft of transom.
Figure 8:
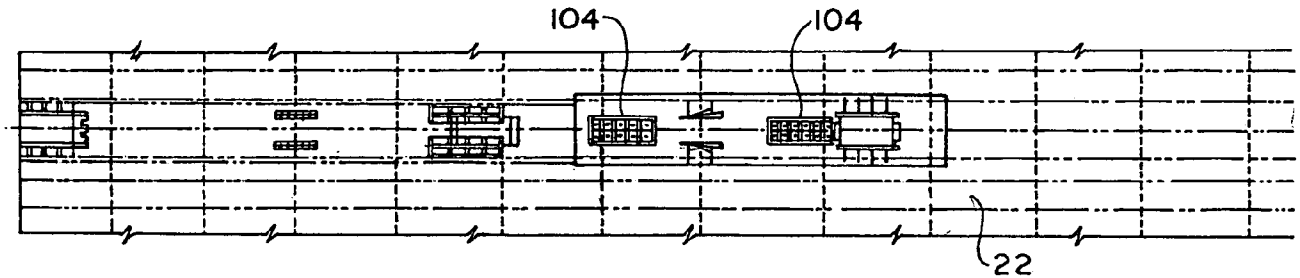
FIG. 8 is a detail plan view of the main deck of the jack-up unit showing new and existing structure at 25 feet off centerline.

In situations where the extension assembly 40 is not needed, the present invention provides for attachment of the active hold-down system directly to the modified cantilever end plate 54, as shown in FIGS. 6–8. In this embodiment, a locking link 90 (shown in detail in FIG. 19) is used. The locking link has a hook-shaped first portion 92, which engages with the fixed pin 56 and rotates relative thereto. The locking link 90 is secured to the end plate 54 by the fixed pin 60, which passes through a central opening 96 formed in the body of the link 90.

Figure 19:
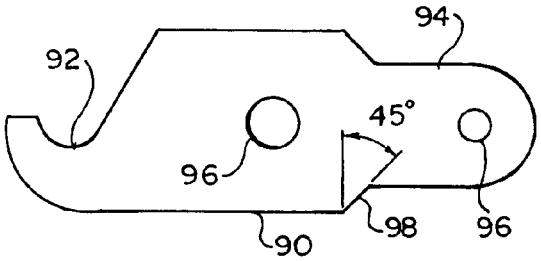
FIG. 19 is a detail view of a portable lock-down link
Figure 24:
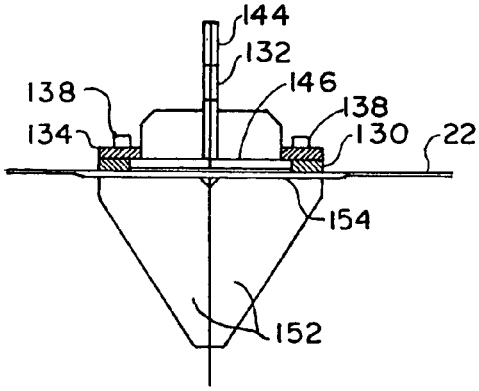
FIG. 24 is a cross-sectional view taken along lines 7—7 in FIG. 23.

The second portion of the locking link 90 is provided with an extension 94 that has an opening 96 for receiving a first securing rod 76 therein. A lower portion of the extension 94 has an angular surface 98, which extends at about 45 degrees relative to a vertical, as shown in FIG. 19. The angular surface limits the relative movement of the rod 76 with respect to the end plate 54.

The present invention provides for two alternative means for securing the active hold-down members 80 to the main deck 22. The first of these means is shown in detail FIGS. 6–8. As can be seen in the drawings, the hydraulic cylinder 80 has a second securing rod 100, which engages the portable padeye 36 (or 38). Bolts 102 to the main deck 22 secure the portable padeye 36. An insert plate 104 is attached to the underside of the deck 22 to reinforce that area of the deck where the constant force hydraulic members 80 are positioned.

It is envisioned that the position of the padeye 36 as shown in FIG. 6 is particularly beneficial for situations where the well centers are at the more extreme aft positions relative to the transom. Position of the locking padeye farther forward on the main deck, as shown in FIG. 7 is believed to be particularly beneficial for wells with centers at less extreme positions relative to the transom. FIGS. 6 and 7 show the cantilever beam 20 in a fully retracted position in phantom lines.

Figure 22:
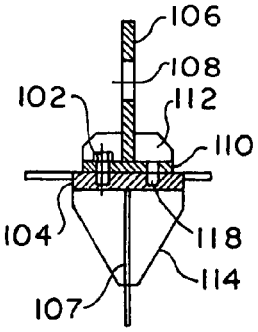
FIG. 22 is a cross-section view of the portable padeye taken along lines 6—6 in FIG. 20.
Figure 23:
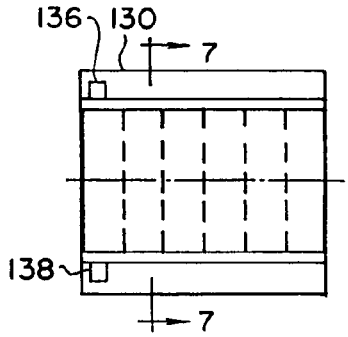
FIG. 23 is a detail plan view showing a fixed lock-down foundation for use with a second embodiment of the hold-down member securing means.
Figure 20:
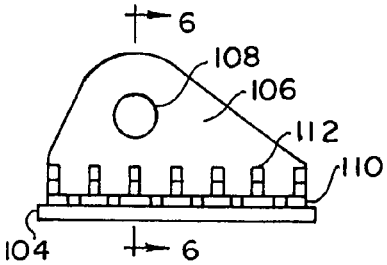
FIG. 20 is a detail view of a portable padeye for use with a first embodiment of the hold-down member securing means.
Figure 25:
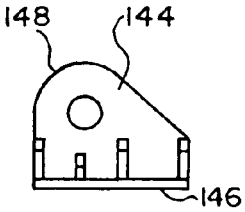
FIG. 25 is a detail view showing a lock-down padeye for use with the second embodiment of the hold-down member securing means.
Figure 26:
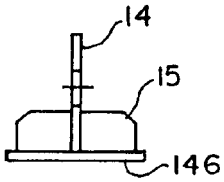
FIG. 26 is a side view of the lock-down padeye shown in FIG. 25.
Figure 21:
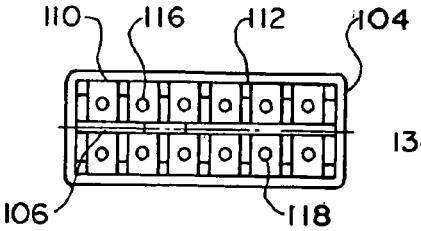
FIG. 21 is a detail plan view of the portable padeye shown in FIG. 20.
Figure 27:
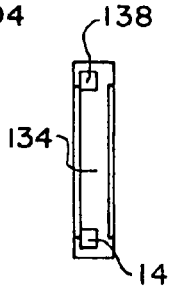
FIG. 27 is a detail view showing a front view of a longitudinal restraint for securing the active hold-down member according to the second embodiment of the securing means.
Figure 28:
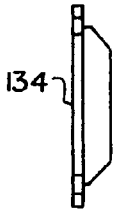
FIG. 28 is a detail side view of the longitudinal restraint member shown in FIG. 27.

The padeye 36 is shown in more detail in FIGS. 20–22. As can be seen in the drawings, the portable padeye 36 (or 38) comprises a vertically extending plate 106 with an opening 108 in an upper portion thereof. The vertical plate 106 extends in alignment with an existing bulkhead 107. The vertical plate 106 is secured at a right angle to a horizontal plate 110. A plurality of chocks 112 extends upwardly from the plate 110. Additionally, downwardly extending chocks 114 extend between the bolt centers below the main deck 22. Each horizontal plate is bolted at two locations 116 and 118 on opposite sides of the vertical plate 106, as can be seen in FIGS. 21 and 22.

Figure 29:
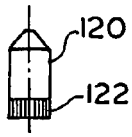
FIG. 29 is a detail view showing a threaded pin guide for temporary use while installing the first embodiment of the securing assembly.

A threaded guide pin 120 (FIG. 29) is used for padeye installation. The pin 120 has threads 122. The pin 120 is temporary used for installation of the padeye assembly 36; it is removed once the bolts 102 are installed.

The second alternative system for securing the hold-down assembly and providing restraint to longitudinal movement of the padeyes is shown in FIGS. 12–17 and in detail in FIGS. 23–26. According to the second embodiment, a fixed locked-down foundation 130 is welded to the main deck 22. A portable padeye 132 is adapted to slide under hold-down plates 134, which are positioned on top of the foundation 130. Square bars 136, 138 fit into openings 140, 142, respectively, formed in the hold-down plates 134.

An upwardly extending plate 144 of the padeye 132 is secured to a horizontal plate 146. An opening 148 is formed in the upper portion of the vertical plate 144 to engage the rod 100 therein. Vertical chock plates 150 extend upwardly from the plate 146; vertical downwardly extending brackets 152 extend below the main deck 22, being secured to an existing insert plate 154. The second embodiment of the securing means for the hold-down members does not require bolts.

Figure 9:
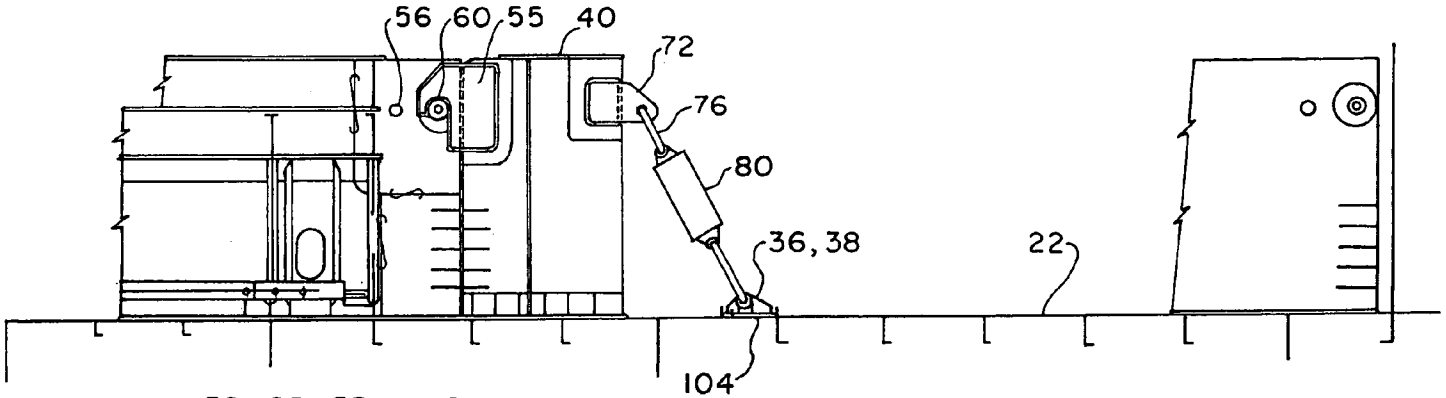
FIG. 9 is a detail view showing the active hold-down member secured to the optional cantilever beam extension suitable for less extreme positions of the well center aft of the transom, and using a first embodiment of a means for securing the hold-down member to the main deck.
Figure 10:
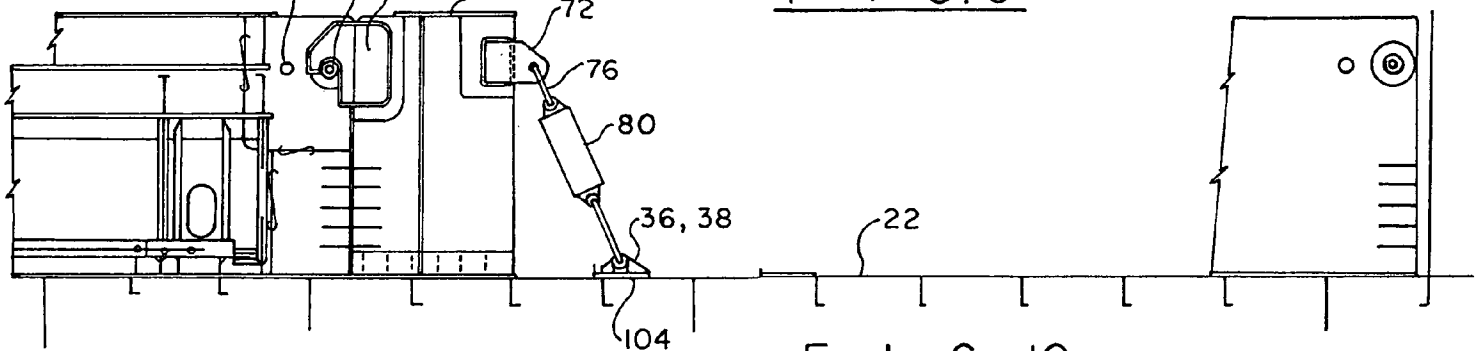
FIG. 10 is a view similar to that shown in FIG. 9 particularly useful for wells with centers at the most extreme positions aft of transom.
Figure 11:
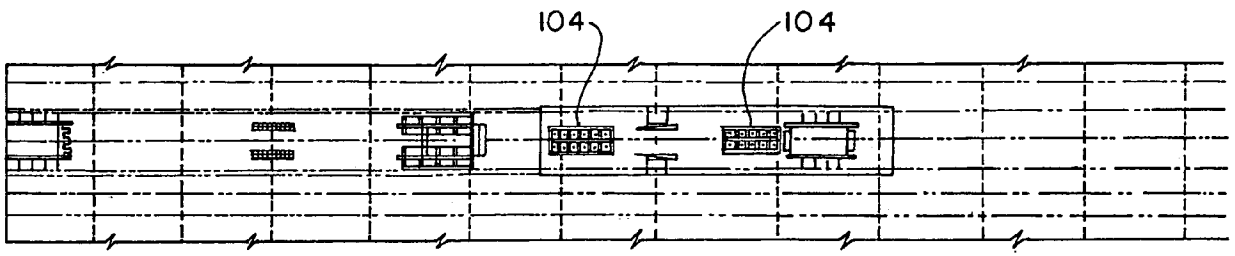
FIG. 11 is a partial plan view showing new and existing structure on the main deck at 25 feet off centerline, typical port/starboard.

Shown in FIGS. 9–11 is the active hold-down system of the present invention utilizing the cantilever beam extension 40 and the first embodiment of the securing means. The illustrated embodiment of FIG. 9 is envisioned for use with well centers at less extreme positions relative to the transom; the embodiment of FIG. 10, with the padeyes 36, 38 in the aft location of the main deck, is believed to be particularly suited for wells with centers at the most extreme positions relative to the transom.

Figure 12:
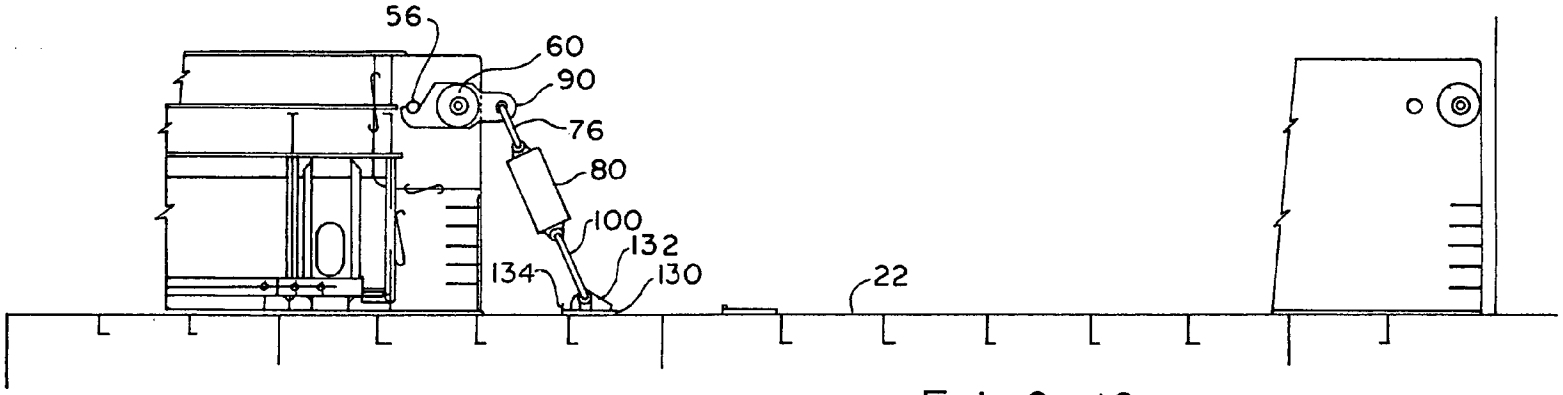
FIG. 12 is a detail view showing the cantilever without beam extension, active hold-down member secured on the main deck with the use of a fixed lock-down foundation, particularly useful for wells with centers at extreme positions aft of transom.
Figure 13:
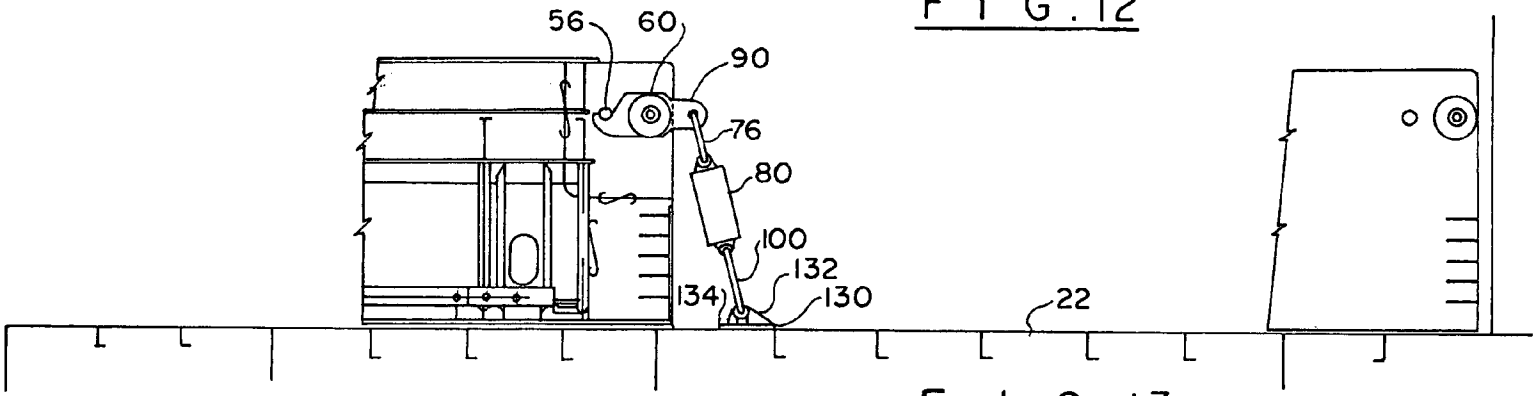
FIG. 13 is a detail view similar to the view of FIG. 12 particularly useful for wells with centers at less extreme positions aft of transom.
Figure 14:
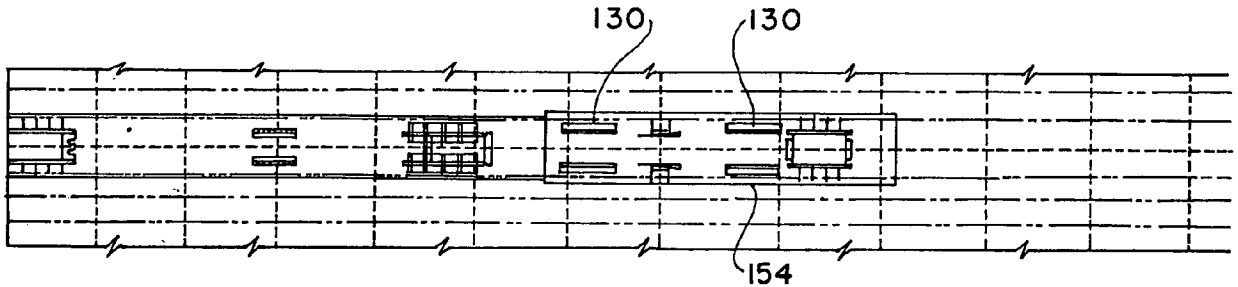
FIG. 14 is a detail view of a portion of the main deck showing new and existing structure and also showing a fixed lock-down foundation.
Figure 15:
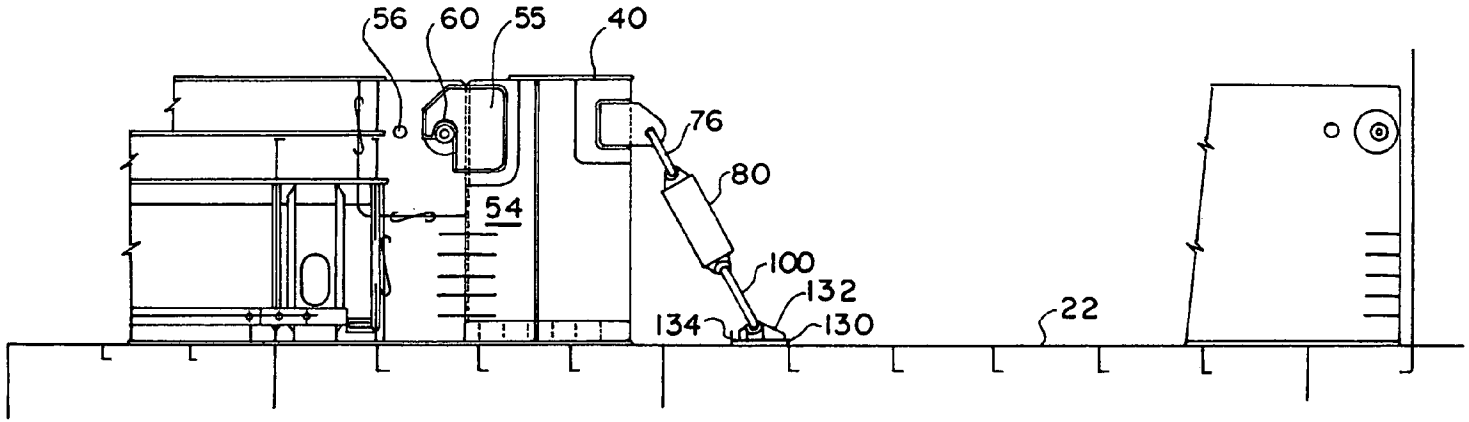
FIG. 15 is a detail view similar to the view of FIG. 12, but with the cantilever beam extension, showing the active restraint system of the present invention particularly adapted for wells with centers at extreme positions aft of transom.
Figure 16:
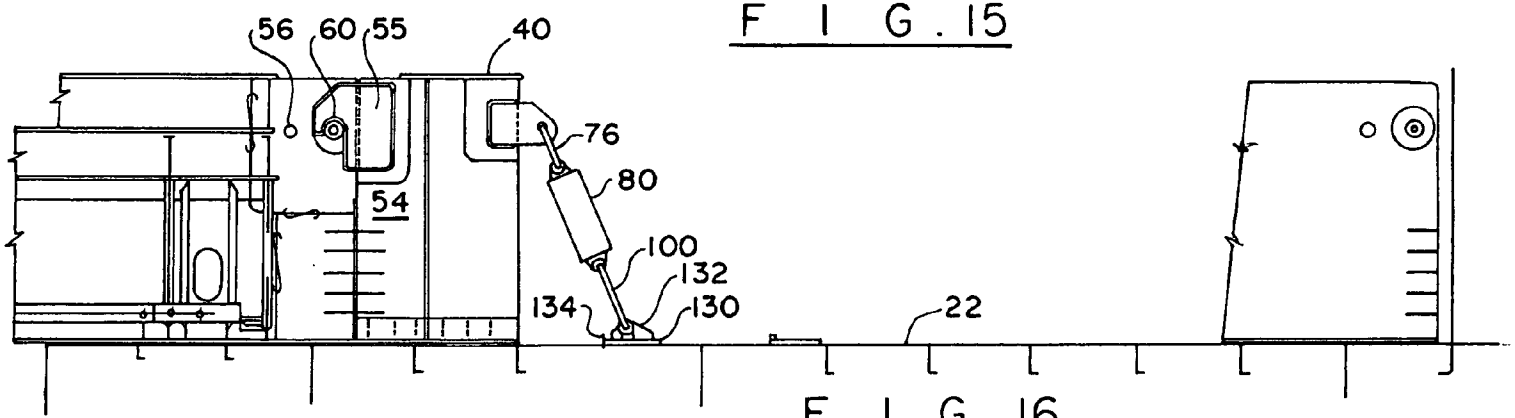
FIG. 16 is a detail view similar to that shown in FIG. 15 particularly adapted for wells with centers at extreme positions aft of transom.
Figure 17:
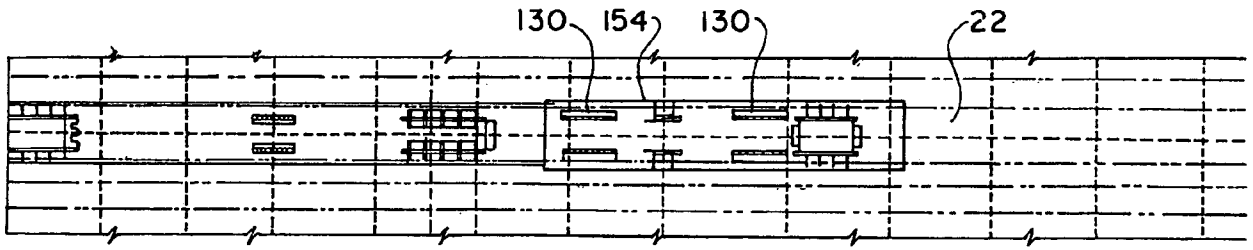
FIG. 17 is a detail plan view of the main deck showing new and existing structure at 25 feet off centerline.

Shown in FIGS. 12–17 is the active hold-down system of the present invention utilizing the cantilever with and without cantilever beam extension 40 and the second embodiment of the securing means. The illustrated embodiment of FIG. 12 is envisioned for use with well centers at extreme positions aft of transom; the embodiment of FIG. 13, with the padeyes 36, 38 located farther forward on the deck is particularly suited for wells with centers at less extreme positions aft of transom. The embodiment shown in FIG. 15 is believed to be beneficial for use with well centers at less than the most extreme positions aft of transom; the embodiment of FIG. 16 is envisioned to be particularly suited for well centers at the most extreme positions aft of transom.

For load calculation purposes, it is assumed that the hold-down limit is at its maximum allowable for existing hold-down clamps. Each of the hydraulic hold-down members 32, 34 has a load of about 1000 Kips port/starboard. It is envisioned that the load capacity of the modified cantilever assembly, with the active hold-down system of the present invention will increase to significantly for extreme well centers. It is also envisioned that the load capacity for the modified cantilever assembly with the hold-down system of the present invention and using the beam extension will also increase significantly. Such characteristics are not available with the currently known cantilever assemblies of comparable weight and load capacity.

The system of the present invention may be used as a sole hold-down system with sufficient power given by the hydraulic cylinders or it may be used to supplement existing hold-down devices present on older jack-up units.

Many changes and modifications may be made in the design of the present invention without departing from the spirit thereof. We, therefore, pray that our rights to the present invention be limited only by the scope of the appended claims.

We claim:

1. An apparatus for applying a constant force to a forward end of a cantilever beam extended from a structure, the apparatus comprising:

at least one hold-down member secured to the cantilever beam to extend at a substantially acute angle to a vertical axis of the cantilever beam a distance from the forward end and exerting a pre-determined restraining force on the cantilever beam, said force having a vertical component; and a means for securing the hold-down member to a structure, from which the cantilever beam extends, said securing means being adapted for re-positioning in relation to the cantilever beam to facilitate variance in the restraining force applied to said cantilever beam.

2. The apparatus of claim 1, wherein said securing means comprises at least one padeye, said at least one padeye having a lower portion releasably securable to the structure and an upper portion securable to said at least one hold-down member.

3. The apparatus of claim 2, wherein said at least one padeye comprises a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate.

4. The apparatus of claim 3, wherein said horizontal plate is securable to the structure, from which said cantilever beam extends.

5. The apparatus of claim 1, wherein said at least one hold-down member is a hydraulic cylinder.

6. An apparatus for applying a constant force to a forward end of a cantilever beam extended from a structure, the apparatus comprising:

at least one hold-down member secured to the cantilever beam a distance from the forward end and exerting a pre-determined restraining force on the cantilever beam, said force having a vertical component;

a means for securing the hold-down member to a structure, from which the cantilever beam extends, said securing means being adapted for re-positioning in relation to the cantilever beam to facilitate variance in the restraining force applied to said cantilever beam; and a beam extension assembly detachably secured to said at least one hold-down member and to the structure, from which the cantilever beam extends.

7. An apparatus for applying a constant force to a forward end of a cantilever beam extended from a structure, the apparatus comprising:

at least one hold-down member secured to the cantilever beam a distance from the forward end and exerting a pre-determined restraining force on the cantilever beam, said force having a vertical component; and a means for securing the hold-down member to a structure, from which the cantilever beam extends, said securing means being adapted for re-positioning in relation to the cantilever beam to facilitate variance in the restraining force applied to said cantilever beam, said securing means comprising at least one padeye, said at least one padeye having a lower portion releasably securable to the structure and an upper portion securable to said at least one hold-down member, and wherein said securing means further comprises a locked-down foundation secured to the structure and a hold-down plate mounted on top of the locked-down foundation, and wherein said at least one padeye is secured under said hold-down plate.

8. An apparatus for applying a constant restraining force on a cantilever beam extended from a deck of an offshore structure and secured to the offshore structure by a cantilever beam clamp, said beam having a forward end, the apparatus comprising:

at least one hold-down member secured to the cantilever beam forward of the cantilever beam clamp to extend at a substantially acute angle to a vertical axis of the cantilever beam and exerting a pre-determined restraining force on the cantilever beam, said force having a vertical component; and a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam.

9. The apparatus of claim 8, wherein said at least one hold-down member is activated by a constant hydraulic force.

10. The apparatus of claim 8, wherein said securing means comprises a plurality of movable padeyes.

11. The apparatus of claim 10, wherein each of said padeyes comprises a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate.

12. The apparatus of claim 11, further comprising a cantilever beam end plate and a locking link for securing one end of said at least one hold-down member to the cantilever beam.

13. An apparatus for applying a constant restraining force on a cantilever beam extended from a deck of an offshore structure and secured to the offshore structure by a cantilever beam clamp, said beam having a forward end, the apparatus comprising:

at least one hold-down member secured to the cantilever beam forward of the cantilever beam clamp and exerting a pre-determined restraining force on the cantilever beam, said force having a vertical component;

a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam, said securing means comprising a plurality of movable padeyes, each of said padeyes comprising a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate; and a plurality of insert plates secured underside of the deck of the offshore structure, and wherein the horizontal plate of each padeye is secured to an upper surface of the deck of the offshore structure in general alignment with a corresponding insert plate.

14. An apparatus for applying a constant restraining force on a cantilever beam extended from a deck of an offshore structure and secured to the offshore structure by a cantilever beam clamp, said beam having a forward end, the apparatus comprising:

at least one hold-down member secured to the cantilever beam forward of the cantilever beam clamp and exerting a pre-determined restraining force on the cantilever beam, said force having a vertical component;

a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam, said securing means comprising a plurality of movable padeyes, each of said padeyes comprising a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate; and a plurality of fixed locked-down foundations secured to an upper surface of the deck of the offshore structure and a securing plate mounted atop of each foundation, and wherein the horizontal plates are positioned between the locked-down foundation and a corresponding securing plate.

15. An apparatus for applying a constant restraining force on a cantilever beam extended from a deck of an offshore structure and secured to the offshore structure by a cantilever beam clamp, said beam having a forward end, the apparatus comprising:

at least one hold-down member secured to the cantilever beam forward of the cantilever beam clamp and exerting a pre-determined restraining force on the cantilever beam, said force having a vertical component;

a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam, said securing means comprising a plurality of movable padeyes, each of said padeyes comprising a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate; and a cantilever beam end plate and an extension member secured to the cantilever beam end plate, said extension member engaging one end of said at least one hold-down member.

16. An apparatus for applying a constant restraining force on a cantilever beam extended from a deck of an offshore structure and secured to the offshore structure by a cantilever beam clamp, said beam having a forward end, the apparatus comprising:

at least one hold-down member secured to the cantilever beam forward of the cantilever beam clamp and exerting a pre-determined restraining force on the cantilever beam, said force having a vertical component;

a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam, said securing means comprising a plurality of movable padeyes, each of said padeyes comprising a vertical plate, a horizontal plate secured at a right angle to the vertical plate and a plurality of chocks extending upwardly from the horizontal plate and attaching the vertical plate to the horizontal plate, and wherein said at least one hold-down member is secured to the vertical plate; and a cantilever beam end plate and a locking link for securing one end of said at least one hold-down member to the cantilever beam, and wherein said locking link comprises a hook-shaped first portion engaging the cantilever beam and a second portion engaging one end of said at least one hold-down member.

17. An apparatus for applying a constant restraining force on a cantilever beam extended from a deck of an offshore structure and secured to the offshore structure by a cantilever beam clamp, said beam having a forward end, the apparatus comprising:

a cantilever beam end plate secured to a free end of the cantilever beam;

at least one hold-down member secured to the cantilever beam end plate forward of the cantilever beam clamp to extend at a substantially acute angle to a vertical axis of the cantilever beam and exerting a pre-determined restraining force on the cantilever beam, said force having a vertical component; and a means for securing the hold-down member to the deck of the offshore structure, from which the cantilever beam extends, said securing means being releasably positioned at multiple pre-determined locations along port and starboard of the offshore structure to facilitate variance in the restraining force applied to said cantilever beam.

18. The apparatus of claim 17, wherein said means for securing said at least one hold-down member comprises a plurality of securing members, each securing member having a first portion releasably secured to the deck of the offshore structure and a second portion secured to one end of said at least one hold-down member.

19. An apparatus for applying a constant restraining force on a cantilever beam extended from a deck of an offshore structure and secured to the offshore structure by a cantilever beam clamp, said beam having a forward end, the apparatus comprising:

a cantilever beam end plate secured to a free end of the cantilever beam;

at least one hold-down member secured to the cantilever beam end plate forward of the cantilever beam clamp and exerting a pre-determined restraining force on the cantilever beam, said force having a vertical component; and a means for securing said at least one hold-down member to the deck of the offshore structure, from which the cantilever beam extends, said securing means being releasably positioned at multiple pre-determined locations along port and starboard of the offshore structure to facilitate variance in the restraining force applied to said cantilever beam, said securing means comprising a plurality of securing members and a plurality of locked-down foundations affixed to the deck of the offshore structure, each securing member having a first portion releasably secured to a corresponding locked-down foundation and a second portion secured to one end of said at least one hold-down member.

20. An apparatus for applying a constant restraining force on a cantilever beam extended from a deck of an offshore structure and secured to the offshore structure by a cantilever beam clamp, said beam having a forward end, the apparatus comprising:

a cantilever beam end plate secured to a free end of the cantilever beam;

at least one hold-down member secured to the cantilever beam end plate forward of the cantilever beam clamp and exerting a pre-determined restraining force on the cantilever beam, said force having a vertical component;

a means for securing said at least one hold-down member to the deck of the offshore structure, from which the cantilever beam extends, said securing means being releasably positioned at multiple pre-determined locations along port and starboard of the offshore structure to facilitate variance in the restraining force applied to said cantilever beam; and a cantilever beam extension member secured to the cantilever beam end plate and to said at least one hold-down member.

* * * * *